US005724880A

United States Patent [19]

Noda

[11] Patent Number: 5,724,880

[45] Date of Patent: Mar. 10, 1998

[54] RODLESS POWER CYLINDER INCLUDING A SECURING MEMBER FOR THE INNER SEAL BAND WHICH PASSES THROUGH THE SLIT IN THE CYLINDER BARREL

[75] Inventor: Mitsuo Noda, Ichinomiya, Japan

[73] Assignee: Howa Machinery Ltd., Japan

[21] Appl. No.: 772,625

[22] Filed: Dec. 23, 1996

[30] Foreign Application Priority Data

Dec. 27, 1995 [JP] Japan ..... 7-353896

[51] Int. Cl.[6] ..... F01B 29/00

[52] U.S. Cl. ..... 92/88; 277/DIG. 7; 29/888.06; 92/128

[58] Field of Search ..... 92/128, 88; 277/DIG. 7; 29/888.06

[56] References Cited

U.S. PATENT DOCUMENTS

| | | | |
|---|---|---|---|
| 4,373,427 | 2/1983 | Garlpaty et al. | 92/88 |
| 4,555,980 | 12/1985 | Höglund | 277/DIG. 7 |
| 4,852,465 | 8/1989 | Rosengren | 92/128 |
| 4,856,415 | 8/1989 | Noda | 92/88 |
| 5,473,971 | 12/1995 | Takeuchi et al. | 92/88 |

FOREIGN PATENT DOCUMENTS

| | | |
|---|---|---|
| 0 033 541 | 8/1981 | European Pat. Off. . |
| 0 082 829 | 6/1983 | European Pat. Off. . |
| 38 02 703 A1 | 8/1988 | Germany . |
| 56-124711 | 9/1981 | Japan . |
| 61-59008 | 3/1986 | Japan . |
| 62-177304 | 8/1987 | Japan . |
| 63-190909 | 8/1988 | Japan . |
| 2-50501 | 4/1990 | Japan . |
| 3-4005 | 1/1991 | Japan . |
| 5-106612 | 4/1993 | Japan . |
| 6-17803 | 1/1994 | Japan . |
| 6-51505 | 7/1994 | Japan . |

OTHER PUBLICATIONS

"Rodless Air Cylinders Present New Design Potential," Richard N. Bailey, Hydraulics & Pneumatics, vol. 40, No. 3, pp. 115–116. Mar. 1987, Cleveland, OH USA.

*Primary Examiner*—Thomas E. Denion

*Attorney, Agent, or Firm*—Finnegan, Henderson, Farabow, Garrett & Dunner, L.L.P.

[57] ABSTRACT

According to the rodless power cylinder of the present invention, plug members are inserted in the bore of the cylinder barrel. A slit is provided on the cylinder barrel and extending in parallel to the axis of the cylinder barrel. A piston is disposed in the bore of the cylinder barrel and is movable along the slit. An external carriage which is connected with the piston by a yoke extending through the slit is provided. An inner seal band which closes the inner opening of the slit is disposed in the cylinder barrel along the slit. The ends of the inner seal band are clamped between the securing screws and the shank of the plug members, The securing screw extends through the slit from a fitting plate disposed on the outer wall of the cylinder barrel. The fitting plate is secured to the outer wall of the cylinder barrel by mounting bolts threaded into the plug members through the slit. Therefore, the inner seal band and the outer seal band can be secured without any machining of the cylinder barrel.

9 Claims, 10 Drawing Sheets

RODLESS POWER CYLINDER INCLUDING A SECURING MEMBER FOR THE INNER SEAL BAND WHICH PASSES THROUGH THE SLIT IN THE CYLINDER BARREL

BACKGROUND OF THE INVENTION

1. Field of the Invention

The present invention relates to a rodless power cylinder having inner and outer seal bands for sealing a slit on the cylinder barrel.

2. Description of the Related Art

A rodless power cylinder which includes a cylinder barrel having an axial slit on the wall, a piston disposed in the cylinder barrel and a inner seal band disposed inside the cylinder barrel along the slit in order to seal the opening of the slit on the wall of cylinder barrel on the both sides of the piston is disclosed in various publications.

For Example (A) Japanese Unexamined Patent Publication (Kokai) No. 3-4005, Japanese Unexamined Patent Publication (Kokai) No. 62-177304, Japanese Unexamined Utility Model Publication (Kokai) No. 2-50501 and Japanese Unexamined Patent Publication (Kokai) No. 63-190909 disclose rodless power cylinders in which the ends of the inner seal band are secured to end caps disposed on both ends of the cylinder barrel at the position outside the ends of the cylinder barrel.

Further, Japanese Unexamined Patent Publication (Kokai) No. 63-190909, Japanese Unexamined Patent Publication (Kokai) No. 6-17803 and Japanese Unexamined Utility Model Publication (Kokai) No. 6-51505 disclose linear actuating devices utilizing a rodless power cylinder of the above type. In the linear actuating devices in the above publications, one or two guide rails which are disposed on the cylinder barrel itself or on a base attached to the cylinder barrel, and a slide table connected to the piston of the rodless power cylinder by a connecting rod through the slit and guided on the guide rails, are provided.

(B) Japanese Unexamined Patent Publication (Kokai) No. 5-106612 discloses a rodless power cylinder in which an outer seal band is disposed on the outer surface of the cylinder barrel along the slit. The ends of the outer seal band are fastened on the cylinder barrel by a fastening block at the portion inside both ends of the cylinder barrel. The fastening block is fixed to the cylinder barrel by two fastening bolts threaded into the outer wall of the cylinder barrel on both sides of the slit.

(C) Japanese Unexamined Patent Publication (Kokai) No. 56-124711 discloses a rodless power cylinder in which end caps are disposed on both ends of the cylinder barrel. In this rodless power cylinder, a circumferential groove is provided on the outer surface of the cylinder barrel near each end thereof, and a retainer ring is fit into the groove. A clamping plate is fitted to the cylinder barrel at the portion inside the retainer ring, and the end cap is fastened to the end of the cylinder barrel by tension bolts connecting the end cap and the clamping plate. The ends of the inner seal band are fastened to the end caps at the portion outside the ends of cylinder barrel. The ends of the outer seal band are fastened to the cylinder barrel by a fastening screw threaded into the clamping plate.

(D) Japanese Unexamined Patent Publication (Kokai) No. 61-59008 discloses a rodless power cylinder in which a portion of an end cap is inserted into the bore of the cylinder barrel, and the ends of inner seal band are clamped to the outer surface of the portions of the end caps inserted into the bore of the cylinder barrel.

In the rodless power cylinders disclosed in the above publications (A), since the ends of the seal bands are secured on the end caps of the cylinder barrel, the axial length of the end cap must be large enough to allow the end of the seal band to be secured. Therefore, in the rodless power cylinders in the above publications (A), the length of the rodless power cylinder becomes large. Further, when the linear actuating device is constructed by clamping a rodless power cylinder between two end plates fixed to a base, since the end caps are not used, this method for fastening the ends of the inner seal band cannot be used.

In the rodless power cylinder disclosed in the above publication (B), threaded bolt holes perpendicular to the axis of the cylinder for fastening bolts must be drilled on the outer surface of the cylinder barrel. Usually, bolt holes which are parallel to the axis of the cylinder barrel are required at the ends of the cylinder barrel to fasten the plug members at the ends thereof. Therefore, in the rodless power cylinder in the above publication (B), additional machining of the cylinder barrel is required to make the threaded bolt holes for the fastening bolts for the seal band. Further, since the direction of these additional treaded bolt holes are different from the bolt holes at the ends of the cylinder barrel, the orientation of the cylinder barrel must be changed on the drilling machine during the machining in order to provide such additional bolt holes. This makes the machining process of the cylinder barrel complicated and, thereby, increases the manufacturing cost.

In the rodless power cylinder disclosed in the above publication (C), the circumferential groove must be machined on the surface of the cylinder barrel. This machining, similarly to the drilling of the threaded bolt holes in the above publication (B), requires additional cost. Further, the arrangement for fastening the end cap to the cylinder barrel, i.e., the clamping plate, the tension bolts and the retainer ring are rather complicated. Also, since the ends of the inner seal band are fixed to the end cap at the portion outside the cylinder barrel, this type of the rodless power cylinder cannot be used for a linear actuating device constructed by clamping the rodless power cylinder between two end plates.

Further, the rodless power cylinder disclosed in the above publication (D), since the ends of the inner seal band are clamped on the surface of the portion of the end caps inserted into the bore, an additional machining of the threaded bolt holes to clamp the seal band is required on the wall of the cylinder barrel. This causes the machining cost of the rodless power cylinder to increase as explained above.

Sometimes, a linear actuating device is constructed by inserting plug members fixed to the end plates. In this type of the linear actuating device, the end plates are fixed on a base plate in such a manner that the distance between the end plates is slightly larger than the length of the cylinder barrel. By inserting the plug members on the end plates into the bore of the cylinder barrel at both ends thereof, the rodless power cylinder is clamped between the end plates. In this type of the linear actuating device, the plug members and the end plates on the both ends of the cylinder barrel are subject to a fluid pressure inside the cylinder barrel which is exerted in the direction which increases the distance between the end plates. Further, when the piston of the rodless power cylinder engages the inserted portion of the plug members at the end of the piston stroke, an impact force is exerted on the plug members and the end plates by the piston in the direction which expands the distance between the end plates. Therefore, in this type of the linear actuating device, if both ends of the inner seal band are fastened to the plug members or the end plates, an excessive tension stress may be exerted on the inner seal band, which may shorten the service life of the inner seal band and may cause the breakage of the inner seal band in an extreme case.

Also, in the rodless power cylinder in which the ends of the inner seal band are secured on the flanks of the plug members at both ends of the cylinder barrel, the ends of the inner seal band must be clamped between the wall of the bore of the cylinder barrel and the flank of the plug member. Sometimes, this causes troubles during the assembly of the rodless power cylinder. This problem is explained with reference to FIG. 10. Namely, when one of the plug members 100 is inserted into one end of the cylinder barrel 102 with one end of the inner seal band in place, the other end of the inner seal band 104 usually does not reach the other end of the cylinder barrel 102. Therefore, at the other end of the cylinder barrel, the inner opening of the slit 103 is not covered by the inner seal band 104. Usually, an annular seal such as an O-ring seal 101 is provided on the flank of the plug member 100. However, if the other plug member is inserted into the cylinder barrel in this condition, since the inner opening of the slit 103 is not covered by the inner seal band 104, the O-ring 101 tends to deform in such a manner that a part of the O-ring 101 enters into the slit 103 as shown in FIG. 10. This deformation of the O-ring 101 sometimes interferes with the end of the inner seal band 104 and hampers the insertion of the plug member 100 and, thereby, prevents the plug member 100 and the end of the inner seal band 104 from being installed in the cylinder barrel 102 properly.

SUMMARY OF THE INVENTION

In view of the problems in the related art as set forth above, one of the objects of the present invention is to provide a simple and efficient arrangement for securing the ends of the inner seal band of the rodless power cylinder.

Further, another object of the present invention is to provide a linear actuating device of a type which clamps the rodless power cylinder between a pair of end plates by inserting the plug members thereof into the bore of cylinder barrel without using fastening bolts and which is capable of preventing an excessive stress from being exerting on the inner seal band.

Also, another object of the present invention is to provide a simple and effective method for assembling a rodless power cylinder in which the plug members can be inserted at the end of the cylinder barrel without causing the interference with the end of the inner seal band.

To achieve the objects and in accordance with the purpose of the invention, as embodied and broadly described herein, the rodless power cylinder of this invention comprises a cylinder barrel provided with a slit on the wall and extending parallel to the axis thereof, plug members, one each disposed at both ends of the cylinder barrel and inserted into the bore of the cylinder barrel, a piston member disposed in the bore of the cylinder barrel and movable therein in the axial direction, an external carriage disposed outside of the cylinder barrel and coupled to the piston by a coupling member through the slit of the cylinder barrel so that the carriage moves integrally with the piston member along the slit, an inner seal band having both ends and disposed on the wall of the bore of the cylinder barrel along the slit in such a manner that the opening of the slit on the wall of the bore of the cylinder barrel is covered by the inner seal band, an outer seal band having two ends and disposed on the outer surface of the cylinder barrel along the slit in such a manner that the opening of the slit on the outer surface of the cylinder barrel is covered by the outer seal band, securing means for securing the ends of the inner seal band to the plug members, the securing means includes fitting members, one each disposed on the outer surface of the cylinder barrel at both ends thereof and fixed to the respective plug members by a fixing member through the slit of the cylinder barrel and a securing member fixed to the fitting member and extends through the slit so as to secure the end of the inner seal band on the surface of the plug member.

According to this aspect of the invention, since the ends of the inner seal band are secured to the surface of the plug members by the securing member fixed to the fitting member and extended through the slit of the cylinder barrel. Further, the fitting member itself is fixed to the plug member by the fixing member extending through the slit. Therefore, since all the parts composing the securing means which secure the ends of the inner seal band to the plug members are fixed to the plug members through the slit of the cylinder barrel, no threaded bolt hole on the surface of the cylinder barrel, i.e., no additional drilling work, is required for securing the ends of the inner seal band.

According to another aspect of the present invention, there is provided a linear actuating device comprising a rodless power cylinder, wherein the rodless power cylinder is clamped between a pair of end plates facing each other at a distance slightly larger than the axial length of the rodless power cylinder, and wherein one of the end plates is provided with a clamping screw which abuts the end face of a plug member inserted into one end of the bore of the cylinder barrel for pushing the plug member in the direction towards the other end plate.

According to this aspect of the invention, since the plug member at one end of the cylinder barrel is always urged by the clamping screw towards the other end of the cylinder barrel, the forces exerted on the plug members from the pressure of the fluid inside the cylinder barrel and from the piston are received by the end plates via the clamping screw. Therefore, no tension stress is exerted on the inner seal band by the plug members.

According to another aspect of the present invention, there is provided a method for assembling a rodless power cylinder having a cylinder barrel with an axial slit opening on the side wall, plug members inserted into the bore of the cylinder barrel at both ends thereof and an inner seal band disposed in the cylinder barrel along the slit in such a manner that the inner seal band covers the opening of the slit on the wall of the bore of the cylinder barrel and that both ends of the inner seal band are held between the respective plug members and the wall of the bore of the cylinder barrel, the method comprising, a step for fitting one of the plug members at one end of the cylinder barrel with one end of the inner seal band in place, a step for holding the other end of the inner seal band on the wall of the bore of the cylinder barrel near the other end thereof in such a manner that the other end of the inner seal band covers the slit opening, a step for placing a cover band having a length larger than the distance between the end of the inner seal band and the other end of the cylinder barrel on the inner wall of the cylinder barrel so that the other end of the inner seal band is covered by one end of the cover band and that the other end of the cover band extends outside of the cylinder barrel, a step for inserting the other plug member into the bore of the other end of the cylinder barrel so that both the cover band and the other end of the inner seal band are held between the other plug member and the wall of the bore of the cylinder barrel, and a step for removing the cover band from the bore of the cylinder barrel by pulling the other end of the cover band towards a direction outside of the cylinder barrel.

According to this aspect of the invention, the other end of the inner seal band and the opening of the slit on the inner surface of the cylinder barrel between the other end of the inner seal band and the other end of the cylinder barrel is covered by the cover band when the other plug member is inserted into the bore of the cylinder barrel. Therefore, the other plug member can be inserted into the bore without causing an interference with the other end of the inner seal band. Thus, the plug members can be easily inserted into the cylinder barrel during the assembly of the rodless power cylinder.

BRIEF DESCRIPTION OF THE DRAWINGS

The present invention will be better understood from the description as set forth hereinafter, with reference to the accompanying drawings in which.

DESCRIPTION OF THE PREFERRED EMBODIMENT

Figure 1:
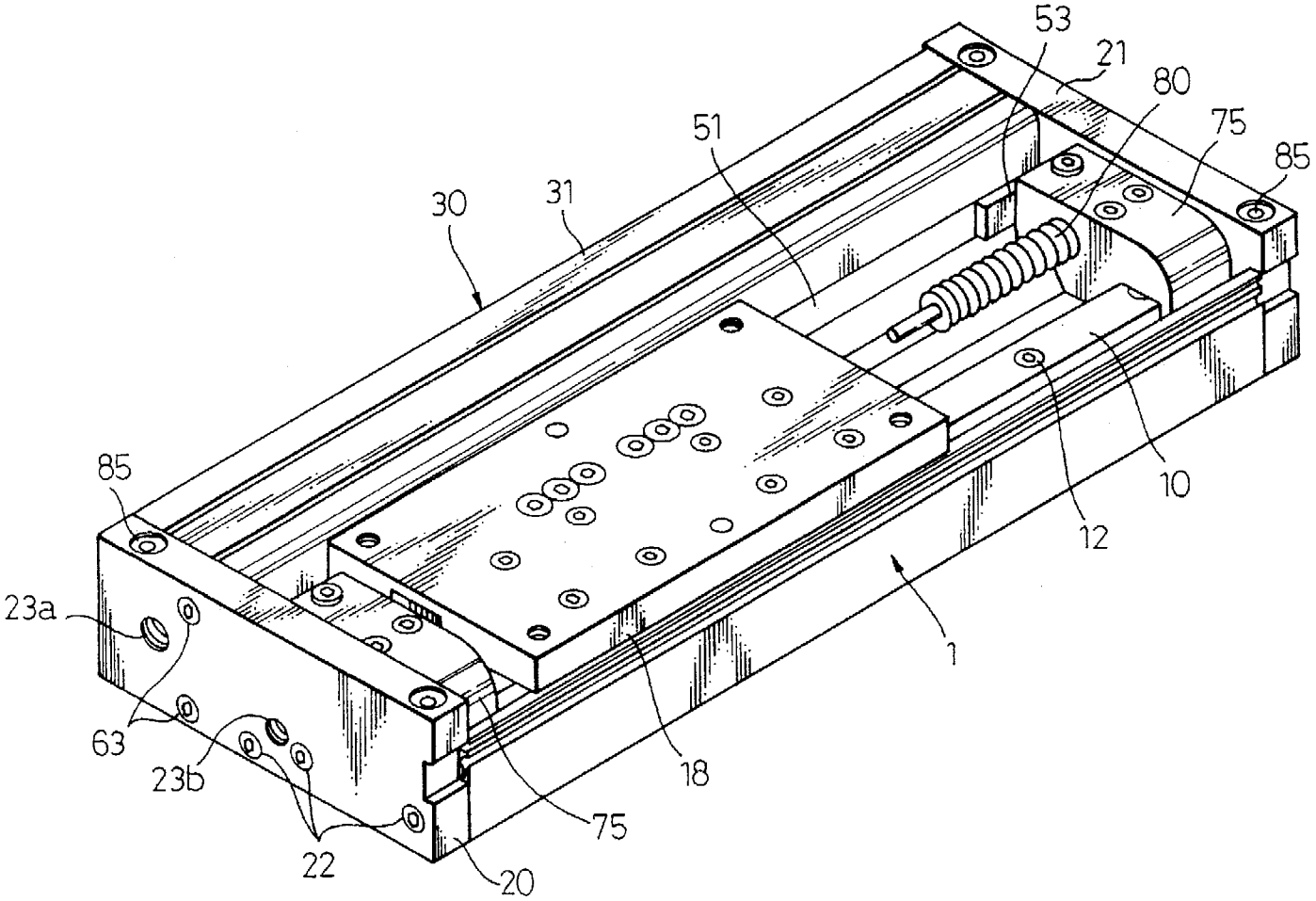
FIG. 1 is a perspective view of a linear actuating device according to an embodiment of the present invention.
Figure 2:
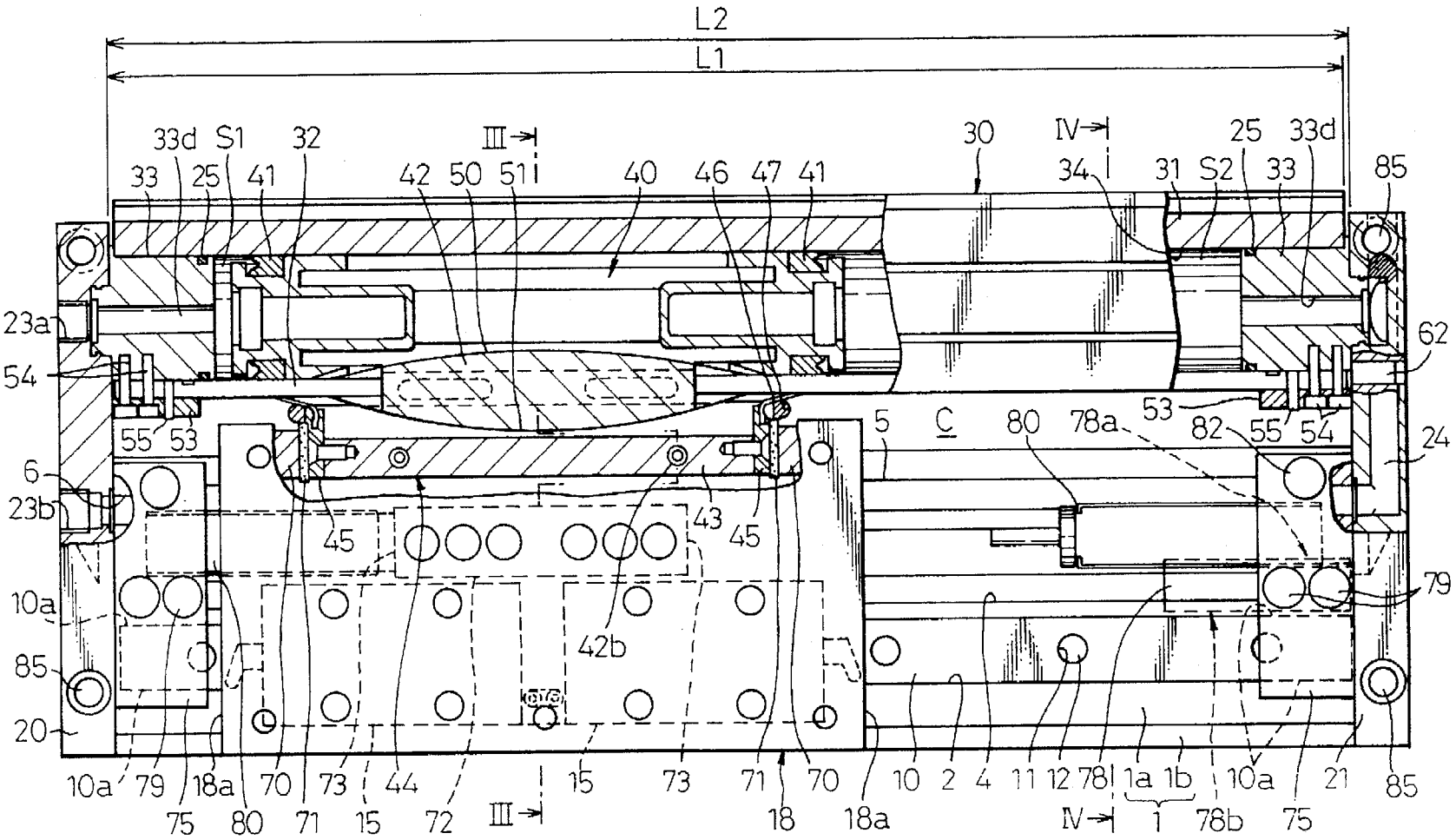
FIG. 2 is a partial sectional plan view of the linear actuating device in FIG. 1.
Figure 3:
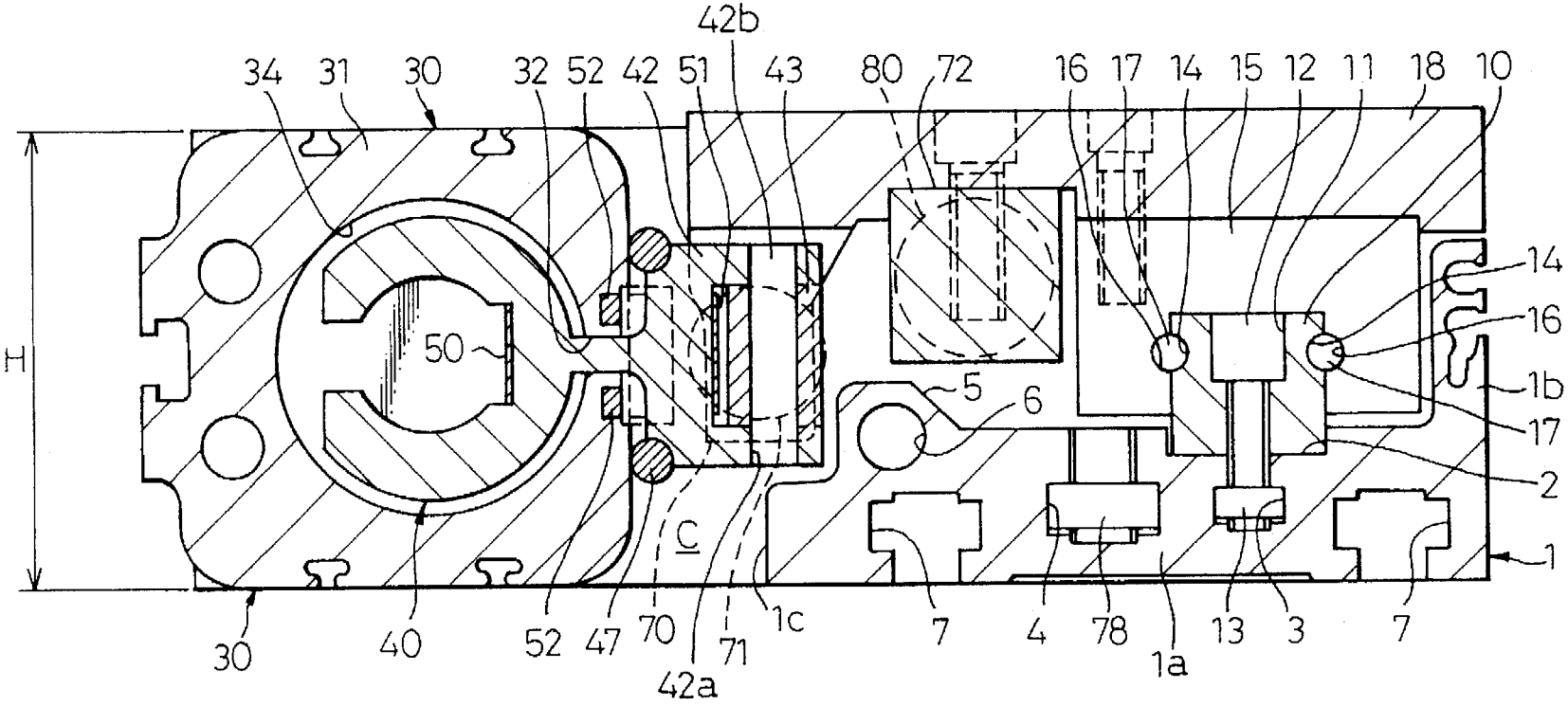
FIGS. 3 is a cross sectional view taken along the line III—III in FIG. 2.

FIGS. 1 through 3 show an embodiment of a linear actuating device having a rodless power cylinder according to the present invention. In FIGS. 1 through 3, reference numeral 1 designates a base of the linear actuating device. The base 1 has a L-shaped cross section having a bottom 1*a* and a side wall 1*b* disposed at the side of the bottom 1*a* and perpendicular thereto. A shallow groove 2 is provided on the upper face of the bottom la along its entire length. This groove 2 is used for mounting a guide rail 10 to the base 1. As best shown in FIG. 3, a T-shaped groove 3 (a groove having a T-shaped cross section) is provided on the bottom surface of the groove 2 along its entire length. Further, another T-shaped groove 4 for mounting stopper member holder 75 runs in parallel to the groove 2 on the upper face of the base 1 on the side of the groove 2 opposite to the side wall 1*b*. The T-shaped groove 4 is also provided over the entire length of the base 1.

A ridge 5 is formed on the upper face of the base 1 at the side 1*c* opposite to the side wall 1*b*. The ridge 5 is formed on the base 1 along the entire length. As shown in FIG. 3, the ridge 5 accommodates a passage 6 for working fluid.

On the lower face of the bottom 1*a*, a pair of T-shaped grooves 7 are provided along the entire length of the bottom 1*a*. The grooves 7 are used for mounting the linear actuating device to other machines. The base 1 in this embodiment is made of aluminum alloy and manufactured by an extrusion process.

The guide rail 10 having a length slightly smaller than the length of the base 1 is disposed in the groove 2 of the base 1. The guide rail 10 has a plurality of threaded bolt holes 10 disposed along the length of the rail 10. The guide rail 10 is mounted on the base 1 by threading mounting bolts 12 into the threaded bolt holes 10 so that the bolts 12 engage with nuts 13 disposed in the T-shaped groove 3. The guide rail 10 is provided with a guide groove 14 on each side thereof which extends over the entire length of the guide rail 10. Though the guide grooves 14 in this embodiment have a semicircular cross section, the guide grooves 14 may have a V-shaped cross section.

Numeral 15 in FIGS. 2 and 3 designates a guide member of the linear actuating device which is guided by the guide rail 10. In this embodiment, two guide members 15 are provided. Each of the guide members 15 straddles and slides on the guide rail 10, and is provided with ball grooves 16 at the portion facing the respective guide grooves 14 of the guide rail 10. The ball grooves 16 and the guide grooves 14 forms passages of balls 17 which act as ball bearings supporting the guide members 15 on the guide rail 10. The guide members 15 are connected to lower face of a slide table 18. Though two guide members 15 are provided in this embodiment, number of the guide members is not limited to two in the present invention.

Numerals 20 and 21 are rectangular end plates which are mounted to the base 1 at the both ends thereof by mounting bolts 22. The respective end plates 20, 21 extend perpendicular to the longitudinal axis of the base 1 in such a manner that the ends of the end plates 20 and 21 extend over the side 1*c* (the side opposite to the side wall 1*b*) of the base 1. As shown in FIG. 3, the heights of the end plates 20 and 21 are made substantially the same as the height H (the height measured in the direction perpendicular to the slit 32) of the cylinder barrel 31 of the rodless power cylinder unit 30 so that a space C for accommodating the rodless power cylinder unit 30 is formed between the end plates 20 and 21. As shown in FIG. 3, the rodless power cylinder unit 30 is disposed between the end plates 20 and 21 in parallel to the guide rail 10.

Figure 6:
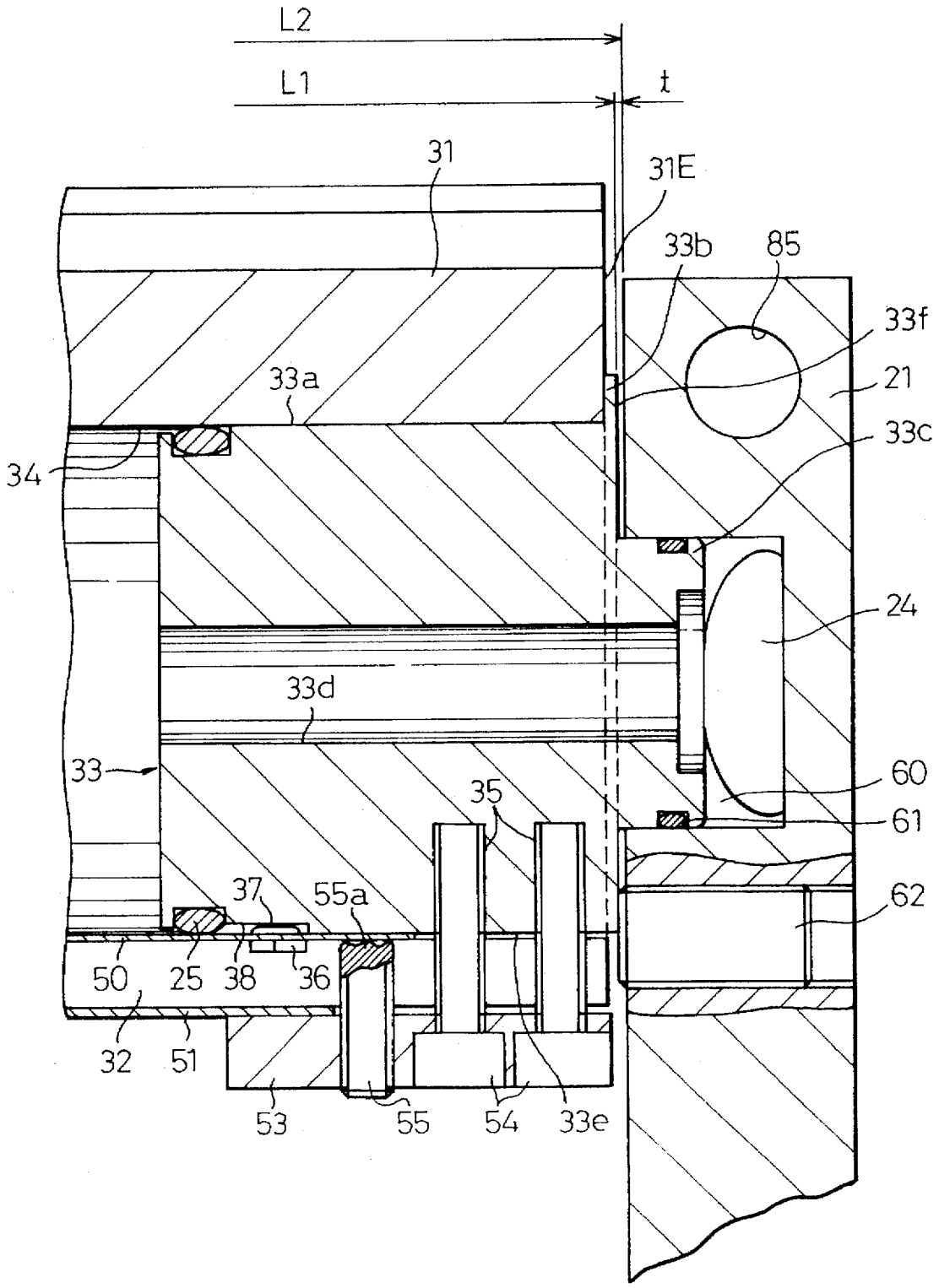
FIG. 6 is an enlarged sectional view of the rodless power cylinder in FIG. 1 which explains the fixture of the end of the inner seal band.

The cylinder barrel 31 of the rodless power cylinder unit 30 has a cross section substantially of a rectangular shape. A slit 32 is provided on the side wall of the cylinder barrel 31 along the entire length thereof. The respective ends of the cylinder barrel 31 are plugged by a plug member 33. FIG. 6 shows the detail of one of the ends of the cylinder barrel 31 (the right hand side end in FIG. 2). As shown in FIG. 6, the plug member 33 comprises a plug portion 33*a* and a thin flange portion 33*b*, and a portion 33*c* which fits into the recessed portion 60 of the end plates 20 and 21.

In the bore 34 of the cylinder barrel 31, a piston 40, which is movable along the longitudinal axis of the cylinder barrel 31, is disposed. As shown in FIG. 2, the plug members 33 on both ends of the cylinder barrel 31 and the piston 40 define two cylinder chambers S1 and S2 in the cylinder barrel 31. Further, a connecting passage 33*d* which opens to the corresponding cylinder chambers S1 and S2 on the both sides of the piston 40 is provided in the respective plug members 33. The plug members 33 are mounted to the ends of the cylinder barrel 31 only by inserting the plug portions 33*a* into the bore 34 of the cylinder barrel 31, i.e., no other fixing means such as fixing bolt is used for mounting the plug members 33 on the cylinder barrel 31. An annular seal member 25 which may be an O-ring seal is mounted on the periphery of the end of the plug portion 33*a* to seal the clearance between the plug portion 33*a* and the wall of the bore 34.

Figure 4:
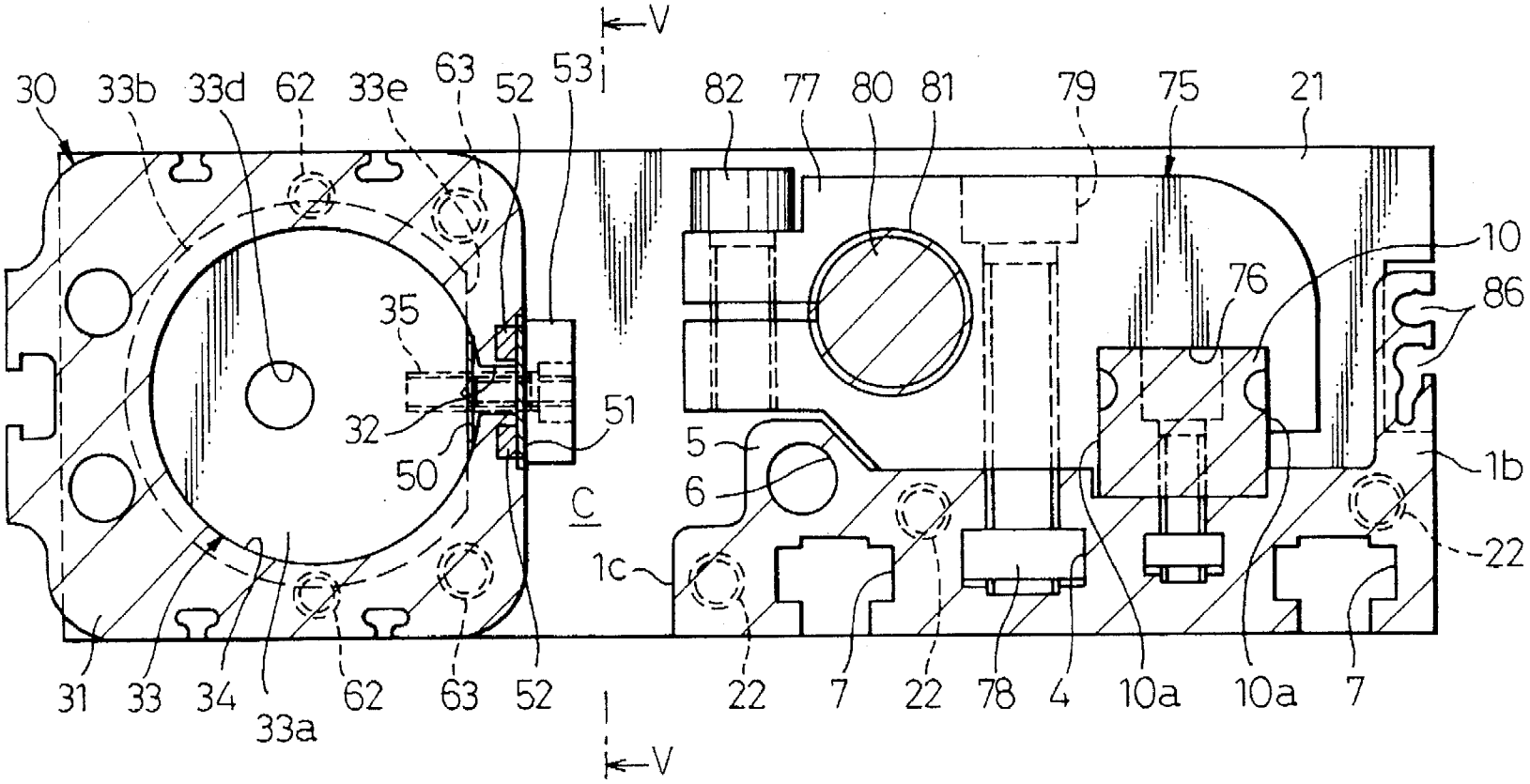
FIG. 4 is a cross sectional view taken along the line IV—IV in FIG. 2.

FIG. 4 is a cross sectional view along the line IV—IV in FIG. 2. As shown in FIG. 4, a part of the plug portion 33*a* and the flange portion 33*b* of the plug member 33 are machined to form a flat portion 33*e* on the side of the plug member 33. As explained later, the flat portion 33*e* is used to facilitate the insertion of the inner seal band between the wall of the bore 34 and the plug member 33 and sliding movement thereof in the direction along the longitudinal axis of the cylinder barrel 31. On the flat portion 33*e* of the plug member 33, two threaded screw holes 35 are disposed at the center of the width of the flat portion 33*e* and arranged in the longitudinal direction of the plug member 33. Further, a groove 38 is provided on the flat portion 33*e*, as best shown in FIG. 6. The groove 38 is disposed at the center of the width of the flat portion 33*e* on the portion between the tip of the plug portion 33*c* and the threaded holes 35. In this embodiment, a washer 36 is attached to each end of the inner seal band 50 by a rivet 37. The groove 38 is provided for accommodating the head of the rivet 37. As shown in FIG. 5, the washer 36 fits into the width of the slit 32 and prevents the inner seal band 50 from deflecting in the direction perpendicular to the slit 32. However, if an appropriate type of the seal band, for example, an elastic seal band having a lip portion fitted into the slit 32 for preventing the deflection of the seal band is used, the washer 36 is not required.

The piston 40 is disposed in the bore 34 and movable in the axial direction of the cylinder barrel 31. As best shown in FIG. 2, a piston packing 41 is provided on each side of the piston 40. Therefore, two cylinder chambers S1 and S2 are defined in the bore 34 of the cylinder barrel 31 by the piston 40. In this embodiment, a part of piston 40 forms a yoke 42 which protrudes to the outside of the cylinder barrel 31 through the slit 32. A mount 43 is coupled to the yoke 42 by means of a plurality of holes 42*a* disposed on the yoke 42 and pins 42*b* fit to the holes 42*a*. An edge plate 45 is attached to each of the axial ends of the mount 43. The mount 43 and the edge plates 45 in this embodiment form an external carriage 44, and the yoke 42 forms a coupling member for connecting the carriage 44 to the piston 40. A scraper 46 is attached to each of the edge plates 45. The scrapers are held in place by an O-ring 47 which surrounds the periphery of the carriage 44. An inner seal band 50 which is disposed inside the cylinder barrel 31 and closes the inner opening of slit 50 and an outer seal band 51 which is disposed outside the cylinder barrel 31 and closes the outer opening of the slit 32 are provided. The inner seal band 50 and outer seal band 51 are guided by guide surfaces in the yoke 42 and run through the carriage 44.

In this embodiment, the inner seal band 50 and the outer seal band 51 are formed as a thin flexible band which made of, for example, a magnetic substance such as stainless chrome steel in this embodiment, magnetic strips 52 are embedded on the outer surface of the cylinder barrel 31 on both sides of the slit 32. Therefore, both the inner seal band 50 and the outer seal band 51 are attracted to the magnetic strips 52 and positively seal the inner and outer openings of the slit 32. Though the seal bands made of magnetic substance are used in this embodiment, flexible seal bands of other type may be used. For example, the seal bands may be made of urethane rubber or nylon, or a combination of chrome steel and rubber. Further, instead of using magnetic strips 52, seal bands may be designed in such a manner that the inner seal band and the outer seal band flexibly engage with each other, or the respective seal bands flexibly engage with the slit 32 in order to seal the slit 32.

Figure 5A:
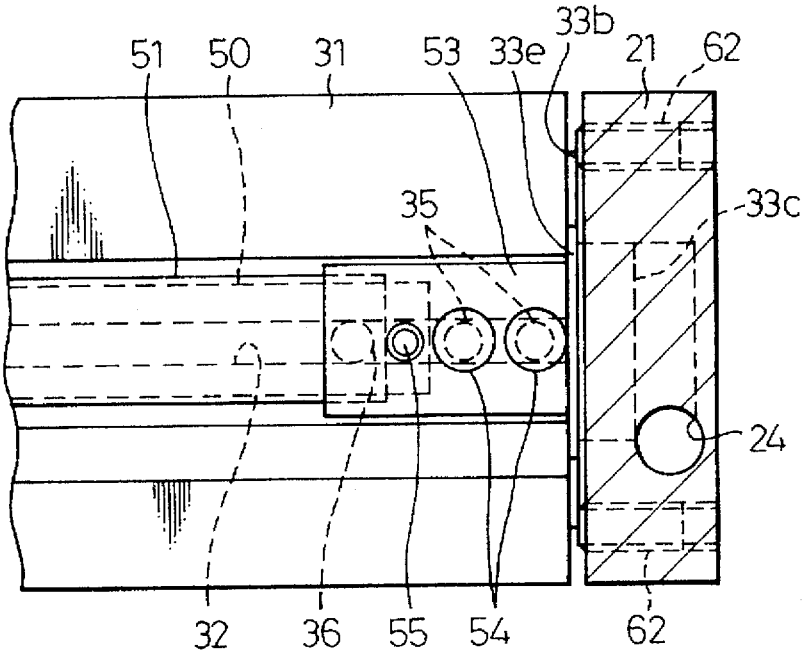
FIG. 5A shows an example of the section of the linear actuating device taken along the line V—V in FIG. 4.

FIG. 5A and FIG. 6 show an example of the fixture of the inner and outer seal bands to the plug member 33. As shown in FIG. 5A, the end portion of the outer seal band 51 is fixed to the outer surface of the cylinder barrel 31 by clamping the end of the outer seal band 51 between a fitting plate 53 and the outer wall surface of the cylinder barrel 31. In this embodiment, the fitting plate is fixed to the cylinder barrel 31 by urging it to the outer surface of the cylinder barrel by two mounting bolts 54. As shown in FIG. 5A, the mounting bolts 54 are threaded into the treaded holes 35 on the plug portion 33*a* of the plug member 33 through the holes provided on the fitting plate 53 and, then, through the slit 32, and the end of the outer seal band is clamped between the cylinder barrel 31 and the fitting plate 53 at the portion inside a securing screw 55 explained later. On the other hand, the end of the inner seal band 50 is fixed to the plug member 33 by clamping the end of the inner seal band 50 between the surface of the plug member 33 and the securing screw 55 in such a manner that the rivet 37 of the inner seal band 50 is accommodated in the groove 38 disposed on the plug portion 33*a* of the plug member 33. In this condition, the washer 36 fits into the slit 32 and, thereby, the movement of the inner seal band 51 in the direction perpendicular to the slit 32 is restricted. The securing screw 55 is threaded into the threaded hole provided on the fitting plate 53 until the pointed tip 55*a* thereof, goes through the slit 32 and bites into the surface of the inner seal band 50. Therefore, the inner seal band 50 is securely fixed to the plug portion 33*a* by the bolt 55.

Figure 5B:
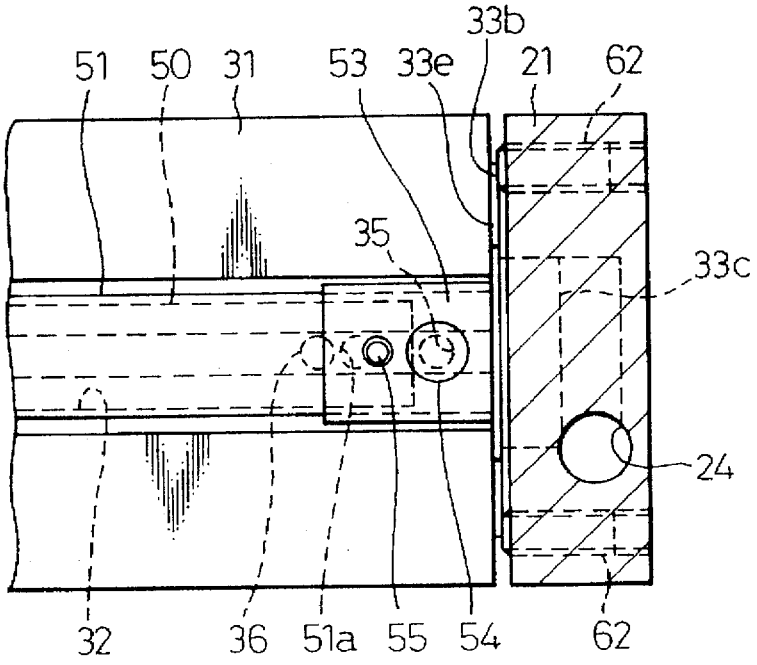
FIG. 5B shows another example of the section of the linear actuating device taken along the line V—V in FIG. 4.

FIG. 5B shows another example of the fixture of the outer seal band 51. In FIG. 5B, the outer seal band 51 is extended to the end portion of the cylinder barrel 31, and a notch 51*a* is formed on the end of the outer seal band 51 so that a U-shaped portion is formed on the end of the outer seal band 51. In this embodiment, one mounting bolt 54 is used for fixing the fitting plate 53 to the cylinder barrel 31. The mounting bolt 54 and the securing screw 55 are arranged so that they go through the slit 32 and the notch 51*a*of the outer seal band 51. in the fixture in FIG. 5*b*, since the legs of the outer seal band material are formed on both sides of the notch 51*a*, the outer seal band 50 is securely fixed to the cylinder barrel 31 even if the fitting plate 53 is slightly raised by the reaction force exerted on the securing screw 55. Since one mounting bolt 54 is sufficient to secure the fitting plate 53 and the outer seal band 51 in this embodiment, the deflection of the cylinder barrel 31 by screwing the mounting bolt 54 can be minimized. Though the notch 51*a*is provided on the outer seal band 51 in this embodiment, another shape of the notch, or an elongated hole may be provided or, alternatively, separate holes for the mounting bolt 54 and the securing screw 55 may be provided.

Next, an embodiment of the arrangement for mounting the cylinder barrel 31 between the end plates 20 and 21 is explained with reference to FIG. 6. As explained before, the plug members 33 are only clamped between the cylinder barrel 31 and the end plates 20 and 21 without using any mounting bolt. The distance between the end plates 20 and 21 (L2 in FIG. 6) is made slightly larger than the distance between the outer faces 33*f* of the flange 33*b* when the plug members 33 are inserted into the cylinder barrel 31 (L1 in FIG. 6). This is required to facilitate the assembly of the cylinder barrel 31 and the end plates 20 and 21. In the assembled condition, the portion 33*c* of the plug member 33, with an O-ring seal 61, fits in the recess 60 disposed on each of the end plates 20 and 21. In this embodiment, as shown in FIG. 6, one of the end plates (in this embodiment, right hand side end plate 21) is provided with a clamping screw 62 at the portion facing the flange portion 33*b* of the plug member 33. The end plates 20, 21 are attached to the end faces of the cylinder barrel 31 by mounting bolts 63 (FIG. 1) after urging the flange portion 33*b* of the plug member 33 by the clamping screw 62 on the end plate 21 toward the other end plate 20. In this condition, a small clearance t remains between the face 33*f* of the flange portion 33*b* and the end plate 21.

In the other end plate 20, an inlet port 23*a* for working fluid is disposed at the portion facing the left hand end of the working fluid passage 6 in the base 1, and an outlet port 23*b* for working fluid is disposed at the portion facing the end of the connecting passage 33*d* in the plug member 33, as shown in FIG. 2, are disposed. Further, a connecting passage 24 which connects the fluid passage 6 to the connecting passage 33*d* of the plug member 33 on the right hand side in FIG. 2 is provided in the end plate 21. Therefore, inlet and outlet pipes of the working fluid can be connected to only one of the end plates (the end plates 20 in this embodiment). Alternatively, the inlet port and outlet port may be provided separately on the respective end plates.

In FIG. 2, the slide table 18 is coupled to the guide member 15 at its side near the side wall 1*b*. The slide table 18 extends from the portion where it is coupled to the guide member 15 to the portion above the external carriage 44, i.e., the slide table 18 does not overlap the cylinder barrel 31 when viewed from the above. On the bottom of the slide table 18, a pair of legs 70 are provided at the portions astride the external carriage 44. The external carriage 44 is clamped between the legs 70 of the slide table via resilient dampers 71 disposed between the edge plates 45 and the legs 70 so that the slide table 18 is driven by the piston 40.

In FIG. 2, numeral 72 shows a stopper which has a length shorter than the length of the slide table 18. The stopper 72 is disposed on the bottom of the slide table in such a manner that end faces 73 thereof are located inside the axial ends 18*a* of the slide table 18. As best shown in FIGS. 2 and 4, the stopper member holders 75 are disposed parallel to the end plates 20 and 21. The stopper member holder 75 has a groove 76 which fits to the guide rail 10. Further, the stopper member holder 75 is fixed to the base 1 by means of the bolt 79 which engages with a nut member 78 in the T-shaped groove 4 on the base 1. Therefore, the position of the stopper member holder 75 in the axial direction of the cylinder barrel 31 can be adjusted arbitrarily by positioning the nut member 78 in the groove 4.

The vertical faces of the groove 76 closely contact the vertical faces 10*a* and 10*b* of the guide rail 10, and do not contact the faces of the guide grooves 14. Further, the nut member 78 in this embodiment has an extended portion 78*b* extending in the T-shaped groove 4, as shown in FIG. 2. The stopper member holder 75 is provided with a threaded hole 81 to receive the shock absorber 80 by engaging the thread provided on the outer surface of the shock absorber 80 with the internal thread of the hole 81. A notch and a mounting screw 82 are provided at the tip 77 of the stopper member holder 75 in order to secure the shock absorber 80 in the hole 81. When the shock absorber 80 is secured in the hole 81, the shock absorber 80 protrudes from the holder 75 toward the stopper 72 of the slide table 18. In certain applications of the linear actuating device, the shock absorber 80 need not be used. Numeral 85 in FIG. 2 are through holes penetrating the end plates 20 and 21 for mounting the linear actuating device to another structure and numeral 86 in FIG. 4 is a groove for mounting auxiliary devices such as switches to the linear actuating device.

In the linear actuating device shown in FIGS. 1 through 4, since the guide rail 10 is fixed to the base 1, and the rodless power cylinder unit is mounted between the end plates 20 and 21 which are also fixed to the base 1. Therefore, even if the linear actuating device is mounted to other structures by the holes 85 on the end plates, the guide rail 10 is rigidly supported by the base 1 (which are rigidly connected to the end plates 20 and 21). Therefore, according to the linear actuating device in the present embodiment, the smooth movement of the slide table 18 is always maintained. Further, since the connecting member (yoke) 42 connecting the piston 40 and the carriage 44 protrudes from the slit 32 in the direction parallel to the slide table (i.e., horizontally, in FIGS. 3 and 4 in this embodiment), the total height of the linear actuating device can be reduced to that substantially the same as the height of the cylinder barrel 31 (the height H in FIG. 3). Therefore, according to the present embodiment very compact and rigid linear actuating device is provided.

When the working fluid such as pressurized air is supplied, the piston 40 of the cylinder barrel 31 moves along the axis of the cylinder barrel and, thereby, the slide table 18 is driven by the carriage 44 on the guide rail 10. When the slide table reaches the end of its stroke, the end face 73 of the stopper 72 strikes the shock absorber 80. Thus, the slide table 18 stops smoothly at its stroke end since the impact of the engagement of the stopper with the stopper member (i.e., shock absorber) is reduced by the shock absorber 80. When the stopper 72 engages with the shock absorber 80, a torque is exerted on the stopper member holder 75. For example, a clock wise torque is exerted on the holder 75 on the right hand side of FIG. 1. However, since the holder 75 is fixed to the guide rail 10 by the groove 76, this torque is received by the base 1 through the guide rail 10. Therefore, the stopper member holder 75 is maintained at a proper position even after a long operating period. Further, though the torque is also exerted by the engagement of the stopper and the shock absorber in the direction in which the holder 75 is raised from the base 1, since the nut member 78 in this embodiment is provided with the extended portion 78*b*, this moment is also conveyed to and received by the base 1. Thus, the loosening of the mounting bolts 79 are prevented. The guide rail 10 contacts the holder 75 by the vertical faces 10*a*, 10*b*, and the guide grooves 14 does not contact the holder 75. Therefore, the movement of the guide member 15 is not affected by the engagement of the stopper and the shock absorber. Further, since the stopper 72 is disposed at the position inside the side faces of the slide table, according to the present embodiment, the stroke of the slide table can be kept long while keeping the length of the linear actuating device small.

During the operation of the linear actuating device, the plug members 33 on the both end of the cylinder barrel 31 receive the working fluid pressure in the cylinder chambers S1 and S2. Further, in the application in which the shock absorber 80 is not used, the piston 40 moves to the end of its stroke and strikes the plug members 33. When the piston 40 strikes the plug member 33, the plug member 33 receives the force from the piston 40 and is pushed toward the end plate. As explained before, the distance between the end plates 20, 21 is made slightly larger than the distance between the flange faces 33*f*. Further, the plug members 33 is not fixed to the cylinder barrel 31. Therefore, when the plug members 33 receives the forces from the piston and from the working fluid, the plug member 33 tends to move towards the end plate. If the plug member move toward the end plate (especially, toward the end plate 21, since the clearance t exists between the flange face 33*f* and the end plate 21), the inner seal band 50 and outer seal band 51 are pulled by the plug member 33. This causes excessive tension in the inner and outer seal bands, and may shorten the service life of the seal bands. However, according to the present embodiment, a clamping screw 62 is provided on the end plate 21 and always urges the flange portion 33*b* towards the opposite end plate 20. Therefore, the force exerted on the plug member 33 is received by the end plates through the clamping screw and, thereby, the plug members are held in place. Thus, according to the present embodiment, excessive tension is not exerted on the seal bands.

Figure 7:
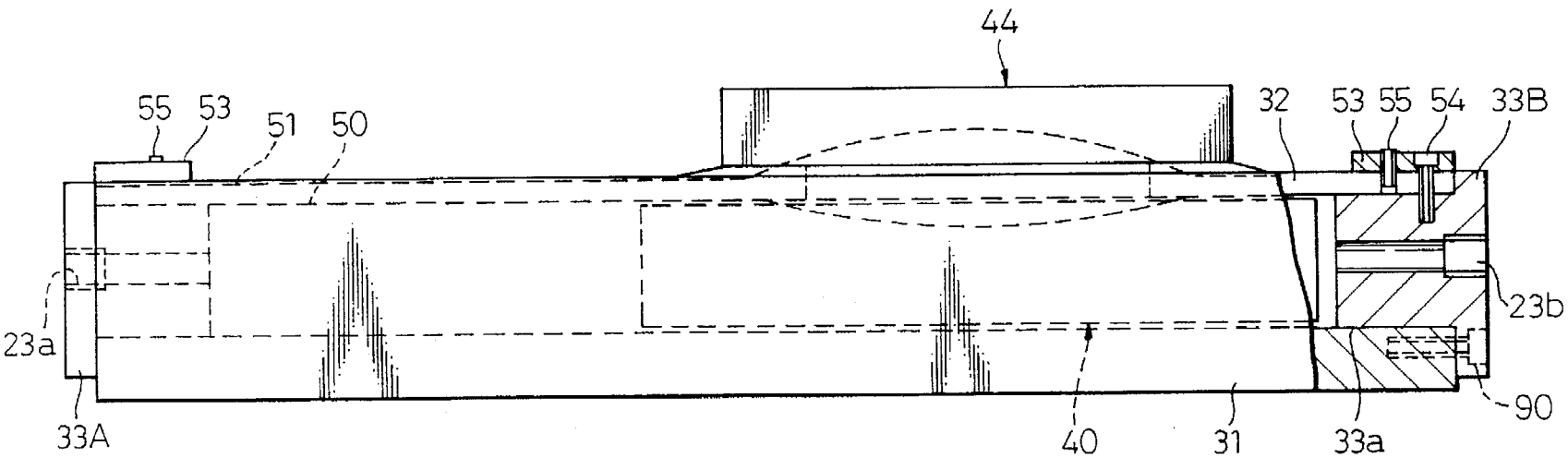
FIG. 7 is a partial sectional side view of a rodless power cylinder unit which shows another embodiment of the fixture of the ends of the inner seal band.

FIG. 7 shows an embodiment in which the arrangement for securing the seal bands according to the present invention is applied to a rodless power cylinder unit itself (i.e., a separate rodless power cylinder which does not compose a linear actuating device). In this case, since the end plates 20, 21 or base 1 are not used, end caps 33A and 33B, instead of the plug members 33 in FIG. 6 are used. The end cap 33A and 33B are fixed to the ends of the cylinder barrel 31 by mounting bolts 90. According to the present invention, as explained before, the ends of the inner seal band 50 and outer seal band 51 are secured on the plug portion 33*a* of the end caps 33A and 33B, i.e., the ends of the seal bands are always located at the portion inside both ends of the cylinder barrel 31. Therefore, the thickness of the portions of the end caps 33A and 33B located on the outside of both ends of the cylinder barrel 31 is only required to accommodate the mounting bolt 90. Therefore, the total length of the rodless power cylinder unit including the thickness of the end caps 33A and 33B is minimized.

Next, an embodiment of the method for assembling the rodless power cylinder 31 according to the present invention is explained with reference to FIGS. 8A, 8B and 9A, 9B. In the embodiments explained above, the end of the inner seal band 50 must be held between the shank of the plug portion 33*a* of the plug member 33 and the wall of the bore 34 of the cylinder barrel 31. Therefore, when the inner seal band is correctly placed, both ends of the inner seal band are located inside the ends of the cylinder barrel 31, i.e., the portions of the slit 32 between the ends of the cylinder barrel 31 and the ends of the inner seal band 50 are not covered by the inner seal band 50. If the plug member 33 is inserted into the bore 34 of the cylinder barrel 31 after placing the inner seal band 50 in the correct position, the O-ring seal 25 disposed on the shank of the plug member 33 may deform and enter into the slit 32 which is not covered by the inner seal band 50. This causes the problem of the interference between the O-ring seal 25 and the inner seal band 50 as explained in FIG. 10, and disturbs proper installation of the plug member 33 and the inner seal band 50.

In the method explained hereinafter, the problem of the interference is solved by providing the flat portion 33*e* on the plug portion 33*a*, and by using the cover band during the insertion of the plug member 33.

Figure 8A:
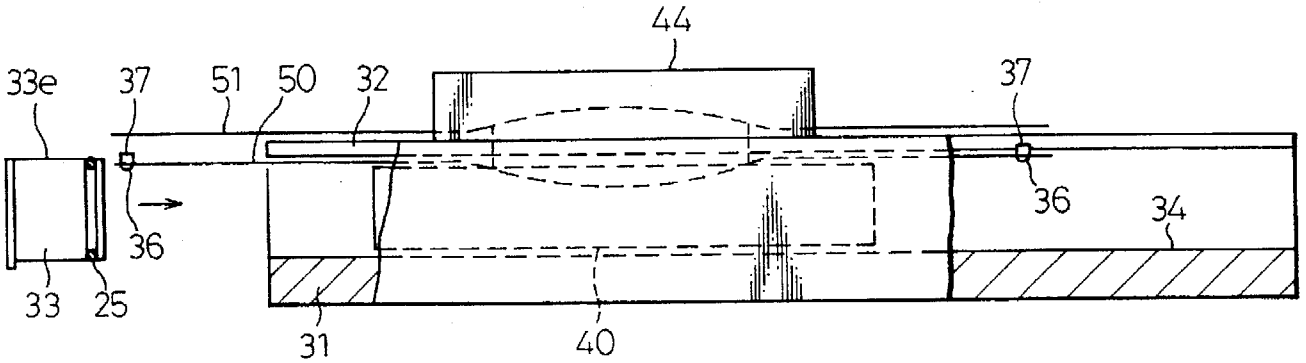
FIGS. 8A, 8B and 9A, 9B are drawings explaining an example of the method for assembling the rodless power cylinder according to the present invention.
Figure 8B:
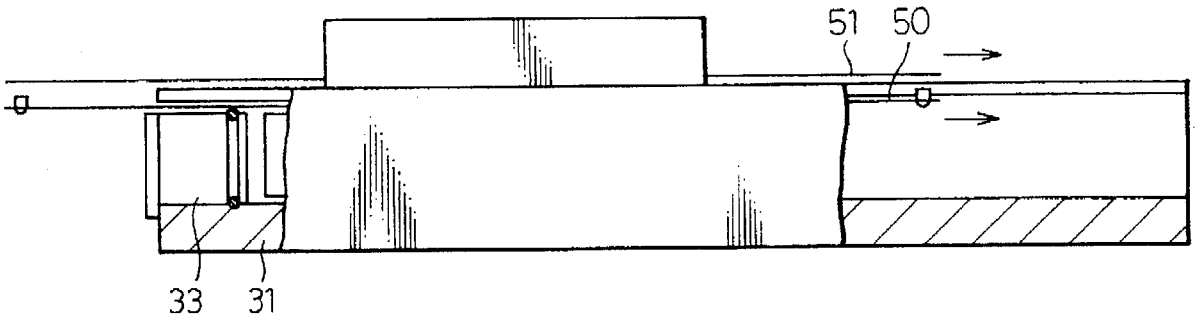
Figure 9A:
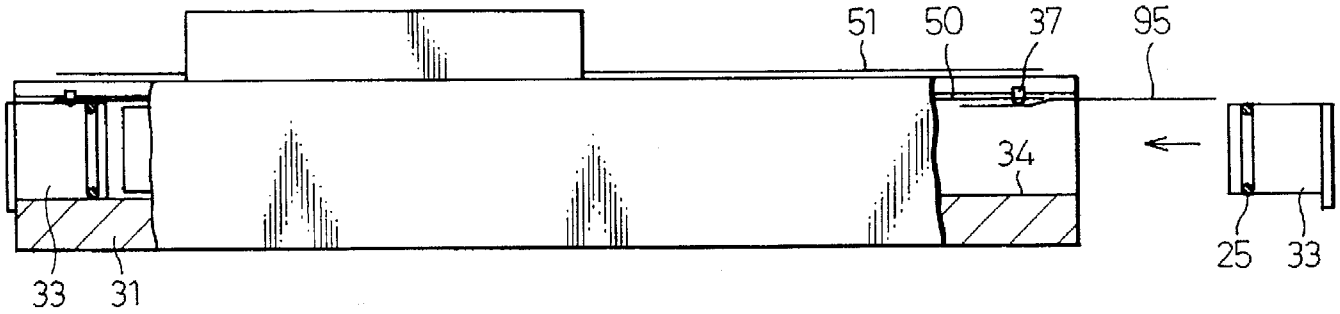
Figure 9B:
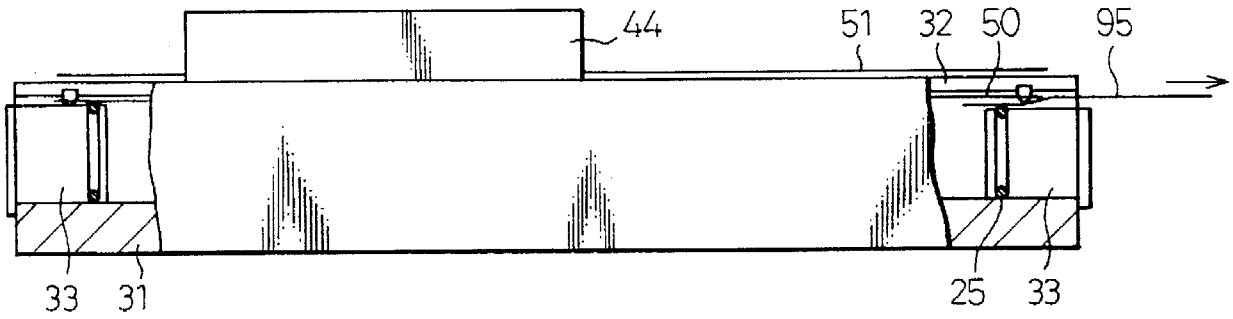
Figure 10:
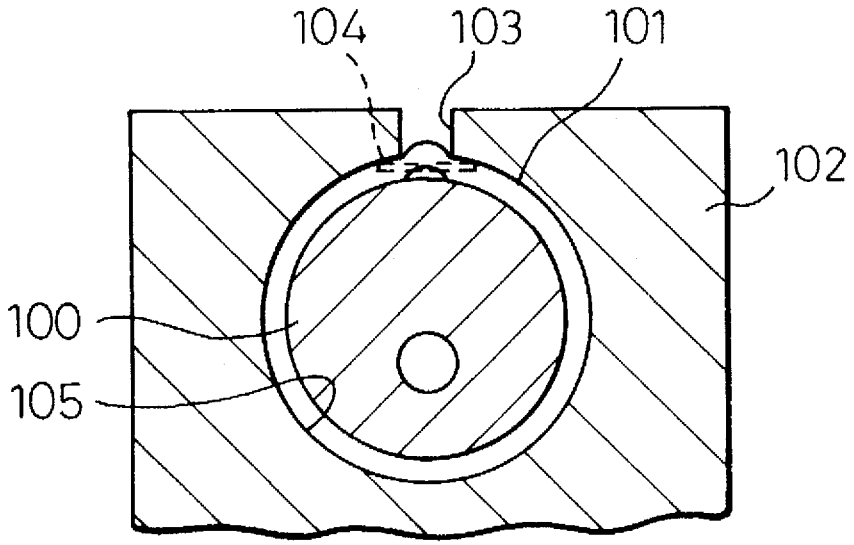
Fig.10 RELATED ART
FIG. 10 is a drawing explaining the problem of the method for assembling the rodless power cylinder in related arts.

FIGS. 8A and 8B show the process for inserting the first plug member (the plug member which is installed in the cylinder barrel 31 first; for example, the left hand side plug member 33 in FIGS. 8A and 8B) into the bore of the cylinder barrel and FIGS. 9A and 9B show the process for inserting the second plug member (the plug member which is installed in the cylinder barrel 31 last; for example, the right hand side plug member 33 in FIGS. 9A and 9B) after the first plug member was inserted into the bore of the cylinder barrel.

As shown in FIG. 8A, in this embodiment, when the first plug member 33 is inserted into the bore 34 of the cylinder barrel 31, the inner seal band 50 and outer seal band 51 are inserted into the external carriage 44 and the piston is placed into the bore 34 in advance. Further, before inserting the first plug member 33, the end of the inner seal band 50 on the side of the first plug member is pulled out from the cylinder barrel 31 as shown in FIG. 8A. In this condition, the other end (the second plug member side end) of the inner seal band 50 is located in the bore 34 and the inner opening of the slit 32 near the first plug member side of the cylinder barrel 31 is covered by the inner seal band 50. Then, the first plug member 33 is inserted into the bore 34 of the cylinder barrel 31 in such a manner that the inner seal band 50 in the cylinder barrel 31 passes the flat portion 33*e* of the first plug member 33. Since the inner opening of the slit 32 is covered by the inner seal band 50 when the first plug member 33 is inserted into the bore 34, the O-ring 25 does not enter into the slit 32, and the first plug member 33 is inserted into the bore 34 of the cylinder barrel 31 smoothly without interfering with the inner seal band 50.

After inserting the first plug member 33 to the correct position, the second plug member side end of the inner seal band (i.e., the end now located in the cylinder barrel 31) is pulled to the other side (the second plug member side) of the cylinder barrel until the inner seal band 50 slides on the flat portion 33*e* of the plug member 33 and the rivet 37 on the first plug member side end of the inner seal band fits into the correct position in the groove 38 on the flat portion 33*e* of the first plug member 33 (FIG. 8B). The inner seal band 50 can be pulled by, for example, engaging a hook with the rivet 37 on the second plug member side end through the slit 32. After the inner seal band 50 is placed in the correct position, the position of the outer seal band 51 is adjusted so that it is placed in the correct position (the position shown in FIG. 6).

When the inner seal band 50 is placed in the correct place, the second plug member side end thereof is located inside the cylinder barrel 31 as shown in FIG. 6, and the portion of the slit 32 between the end of the inner seal band 50 and the end of the cylinder barrel 31 is not covered with the inner seal band. Therefore, in this embodiment, before inserting the second plug member (right hand side plug member 33 in FIGS. 9A and 9B), a cover band 95 is placed in the bore of the cylinder barrel 31 in such a manner that the cover band 95 extends from the second plug member side end of the inner seal band 50 to the outside of the second plug member side end of the cylinder barrel 31 (FIG. 9A). The cover band 95 is a thin, flexible band made of, for example, material the same as that of the inner seal band 50.

Then, the second plug member 33 is inserted into the bore 34 of the cylinder barrel 31 so that the flat portion 33*e* thereof matches the cover band 95 (and the inner seal band 50). Since the inner opening of the slit 32 is covered by the cover band 95, the second plug member 33 is inserted into the bore 34 smoothly. After inserting the second plug member 33 to the correct place in the cylinder barrel 31, the cover band 95 is pulled out from the bore 34 of the cylinder barrel 31 (FIG. 9B). Thus, the second plug member side end of the inner seal band 50 remains in the correct position as shown in FIG. 6 after the cover band 95 is removed.

After removing the cover band 95, the position of the inner seal band 50 and outer seal band 51 are precisely adjusted, and the both ends of the outer seal band 51 are secured to the cylinder barrel 31 by the fitting plates 53 and mounting bolts 54. Then, both ends of the inner seal band 50 are secured to the plug portions 33*a* of the plug members 33 by the securing screw 55. Alternatively, the first plug member side ends of the inner and outer seal bands may be secured to the cylinder barrel and first plug member before inserting the second plug member.

The method explained above can be applied both with the rodless power cylinder unit incorporated into a linear actuating device and the rodless power cylinder by itself.

I claim:

1. A rodless power cylinder comprising:

a cylinder barrel provided with a slit on the wall and extending parallel to the axis of the cylinder barrel;

plug members, individually disposed at both ends of the cylinder barrel and inserted into the bore thereof;

a piston member disposed in the bore of the cylinder barrel and movable therein in the axial direction;

an external carriage disposed outside of the cylinder barrel and coupled to the piston by a coupling member through the slit of the cylinder barrel so that said carriage moves integrally with the piston member along said slit;

an inner seal band having both ends disposed on the wall of the bore of the cylinder barrel along said slit so that the opening of the slit on the wall of the bore of the cylinder barrel is covered by said inner seal band;

an outer seal band having both ends disposed on the outer surface of the cylinder barrel along said slit so that the opening of the slit on the outer surface of the cylinder barrel is covered by said outer seal band;

securing means for securing the ends of the inner seal band to the plug members, said securing means includes fitting members individually, disposed on the outer surface of the cylinder barrel at each end thereof and fixed to the respective plug members by a fixing member through the slit of the cylinder barrel and a securing member fixed to said fitting member and extending through said slit so as to secure the end of the inner seal band on the surface of the plug member.

2. A rodless power cylinder according to claim 1, wherein each said fitting member is a plate disposed on the outer surface of the cylinder barrel, and said fixing member is a bolt which is threaded into the plug member through the slit of the cylinder barrel so as to urge said plate to the surface of the cylinder barrel.

3. A rodless power cylinder according to claim 1, wherein said securing member is a screw threaded to the fitting member and extending through the slit of the cylinder barrel so as to clamp the end of the inner seal band between the tip thereof and the surface of the plug member.

4. A rodless power cylinder according to claim 1, wherein each said fitting member secures the end of the outer seal band to the outer surface of the cylinder barrel by clamping the end of the outer seal band between the outer surface of the cylinder barrel and the fitting member.

5. A rodless power cylinder according to claim 4, wherein each said fitting member is a plate disposed on the outer surface of the cylinder barrel, and said fixing member is a bolt which is threaded to the plug member through the slit of the cylinder barrel so as to clamp the end of the outer seal band between the outer surface of the cylinder barrel and said plate, and wherein said bolt passes through a through hole provided on the end portion of the outer seal band so that the portions of the outer seal band on the both sides of the through hole are clamped between the outer surface of the cylinder barrel and said plate.

6. A rodless power cylinder according to claim 1, wherein each said plug member includes an annular seal disposed around the plug member for sealing the clearance between the plug member and the surface of the bore of the cylinder barrel, and wherein the ends of the inner seal band are secured to the plug members at the portion outside of the annular seal with respect to the center of the axial length of the cylinder barrel.

7. A method for assembling a rodless power cylinder having a cylinder barrel with an axial slit opening on the side wall, plug members inserted into the bore of the cylinder barrel at both ends thereof and an inner seal band disposed in the cylinder barrel along the slit in such a manner that the inner seal band covers the opening of the slit on the wall of the bore of the cylinder barrel and that both ends of the inner seal band are held between the respective plug members and the wall of the bore of the cylinder barrel, said method comprising:

fitting one of the plug members at one end of the cylinder barrel with one end of the inner seal band in place;

holding the other end of the inner seal band on the wall of the bore of the cylinder barrel near the other end thereof in such a manner that said other end of the inner seal band covers the slit opening;

placing a cover band having a length larger than the distance between said end of the inner seal band and the other end of the cylinder barrel on the inner wall of the cylinder barrel so that said other end of the inner seal band is covered by one end of said cover band and that the other end of the cover band extends outside of the cylinder barrel;

inserting the other plug member into the bore of the other end of the cylinder barrel so that both the cover band and said other end of the inner seal band are held between said other plug member and the wall of the bore of the cylinder barrel; and removing the cover band from the bore of the cylinder barrel by pulling said other end of the cover band towards a direction outside of the cylinder barrel.

8. A method for assembling a rodless power cylinder according to claim 7, wherein the respective plug members are provided with a flattened portion on the shank thereof for receiving the end of the inner seal band between the wall of the bore of the cylinder barrel and said flattened portion, and wherein said step for fitting one of the plug members at one end of the cylinder barrel with one end of the inner seal band in place further comprises inserting said one of the plug members with the portion of inner seal band between both ends thereof being placed on said flattened portion, and pulling the ends of the inner seal band which is located in the cylinder barrel in the direction opposite to said one end of the cylinder barrel so that the inner seal band slides through the clearance between the flattened portion and the wall of the bore of the cylinder barrel until said one end of the inner seal band reaches the required position on the flattened portion.

9. A linear actuating device comprising a rodless power cylinder including:

a cylinder barrel provided with a slit on the wall and extending parallel to the axis of the cylinder barrel;

plug members individually disposed at both ends of the cylinder barrel and inserted into the bore thereof;

a piston member disposed in the bore of the cylinder barrel and movable therein in the axial direction;

an external carriage disposed outside of the cylinder barrel and coupled to the piston by a coupling member through the slit of the cylinder barrel so that said carriage moves integrally with the piston member along said slit;

an inner seal band having both ends disposed on the wall of the bore of the cylinder barrel along said slit so that the opening of the slit on the wall of the bore of the cylinder barrel is covered by said inner seal band;

an outer seal band having both ends disposed on the outer surface of the cylinder barrel along said slit so that the opening of the slit on the outer surface of the cylinder barrel is covered by said outer seal band;

securing means for securing the ends of the inner seal band to the plug members, said securing means including fitting members individually disposed on the outer surface of the cylinder barrel at each end thereof and fixed to the respective plug members by a fixing member through the slit of the cylinder barrel, and a securing member fixed to said fitting member and extending through said slit so as to secure the end of the inner seal band on the surface of the plug member; and wherein said rodless power cylinder is clamped between a pair of end plates facing each other at a distance slightly larger than the axial length of the rodless power cylinder, and wherein one of said end plates is provided with a clamping screw which abuts the end face of the adjacent plug member for pushing said plug member in the direction towards the other end plate.

* * * * *